US005626106A

United States Patent [19]

Erickson et al.

[11] Patent Number: 5,626,106

[45] Date of Patent: May 6, 1997

[54] MIGRATING COMBUSTION CHAMBER ENGINE

[75] Inventors: Frederick L. Erickson; Frederick Lynn Erickson; Jeffrey L. Erickson, all of Fort Wayne, Ind.

[73] Assignee: Engine Research Associates, Inc., Fort Wayne, Ind.

[21] Appl. No.: 628,998

[22] Filed: Apr. 10, 1996

[51] Int. Cl.[6] ..... F02B 59/00

[52] U.S. Cl. ..... 123/42; 123/61 R

[58] Field of Search ..... 123/42, 197.1, 123/50 R, 45 R, 47 R, 61 R, 63, 68, 193.6, 193.4

[56] References Cited

U.S. PATENT DOCUMENTS

| | | | |
|---|---|---|---|
| 3,630,178 | 12/1971 | Erickson | 123/42 |
| 4,325,331 | 4/1982 | Erickson | 123/42 |
| 4,437,437 | 3/1984 | Erickson | 123/42 |
| 5,083,536 | 1/1992 | Ariga | 123/193.6 |
| 5,341,774 | 8/1994 | Erickson | 123/42 |
| 5,490,445 | 2/1996 | Rao et al. | 123/193.6 |

*Primary Examiner*—David A. Okonsky
*Attorney, Agent, or Firm*—Roger M. Rickert

[57] ABSTRACT

Design Improvements are disclosed which enhance the migrating combustion chamber engine's ability to achieve improved performance, obtain higher durability and cost less to manufacture. These include strip seals between the combustion chamber member and orbiting piston which are adapted to respond to the pressure of combustion to increase contact pressure and improve retention of the gases in the combustion chambers as well as improved porting located in at least one power block sidewall and cooperating with the migrating combustion chamber to convey hot combustion gasses from a combustion chamber to a corresponding secondary expansion chamber. The combustion chamber member may be formed of two reciprocable piston portions and a pair of separate alloy steel connecting bars coupling the piston portions together. The connecting bars made of a low thermal conductivity material to remain hot and aid in fuel evaporation. A one piece counterweight hub provides all required counterweights. It attaches to the crankshaft by a first clamp which clamps the counterweight hub onto the crankshaft, and second clamp which pulls an inside bore of the hub axially tight against an end of the crankshaft. Improvements in exhaust porting, ignition location, manifold and combustion chamber member designs as well as unique power block housing wear strips and crankshaft counterbalancing techniques are also disclosed.

22 Claims, 16 Drawing Sheets

MIGRATING COMBUSTION CHAMBER ENGINE

BACKGROUND OF THE INVENTION

The present invention relates to improvements to enhance the performance, durability and manufacturability of the Migrating Combustion Chamber (MCC) engine. Reference is made to two types of MCC engines which these improvement features will apply to. The first applicable type of the MCC engine is the full expansion variant described in U.S. Pat. Nos. 4,325,331 and 4,437,437. A second type of MCC engine which can benefit from these same improvements is the self-supercharged two stroke MCC engine as described in U.S. Pat. Nos. 3,630,178 and 5,341,774. Even though these two types of engines operate with totally different cycles of operation, their basic MCC mechanism is fundamentally the same and the improvements set forth in this patent will generally apply to each type. In some instances where in the disclosed feature is applicable to one specific type, the type will be referenced.

The present invention thus describes a number of important features which have been developed from an aggressive in-house development program directed toward advancing the MCC engine into the commercial market place. These features now enable the MCC engine to be highly competitive with the present commercially available engines in three major improvement areas. These areas are:

Performance—Dealing in power, economy, lower pumping losses, lower emissions, thermal dissipation and features to enhance fast burn.

Durability—Dealing in longer life, lower thermal stress, reduced sliding forces and lubrication features.

Ease of Manufacture—Construction expedients, simplification features and combining functions to simplify manufacturing.

Accordingly, the first areas of improvement to be described are the following features to enhance performance:

Strip Seal Pressure Backing—Performance gains in terms of achieving more stable operation and also to produce higher torque at a high brake mean effective pressure are directly related to provisions incorporated into the seals and the associated working parts to assure the seal is always pressed against the two primary sealing surfaces as compression, ignition and expansion are completed. A method is disclosed which illustrates how the pressure developed in the combustion chamber during compression, ignition and expansion is routed in behind the seal to keep the seal properly engaged with the sealing surface. The pressure backing feature disclosed in this invention describes certain provisions to be made to both the strip seals and also to the working members such as the orbiting piston (OP) and Combustion, Chamber Member (CCM) in order to properly route the pressure around and in back of the seal. Thus, it is a first object of this invention to provide a means to improve performance over a broad range of loads and rotational speeds.

A second provision of this invention is to incorporate a means to increase fuel efficiency in the case of the full expansion variant of this engine by the incorporation of certain side ports located in the front and rear power blocks. These ports provide a better means to precisely control the closing of the secondary expansion chamber from the main combustion chamber relative to the closing of the induction port. The increase in fuel efficiency results from the ability to trap more of the combustible mixture in the combustion chamber with less chance of diverting a portion of it to the secondary expansion chamber. Therefore a second objective of this invention is to provide a more fuel efficient MCC engine.

A further aspect of this invention is to reduce the internal pumping losses during the exhaust gas extraction stroke of the full expansion variant of this engine. A method to change the timing by incorporating a rotary valve to control the point in the cycle when the exhaust gas begins to be pumped out will be described as to how the undesirable flow of exhaust gas back into the secondary expansion chamber can be virtually eliminated. Yet a further object of this invention will be to incorporate rotary valve porting control to reduce pumping losses with an attendant increase in fuel efficiency.

Another primary object to boost performance of the MCC engine is to provide the largest exhaust port area through the orbiting piston to achieve the lowest possible pumping losses during the exhaust function. Accordingly, it has been found that a very specific exhaust gas port shape in the OP will allow efficient exhaust gas extraction without exposing the induction ports to the exhaust gas ejection process. A further object of this invention is to describe the dimensional configuration between the OP exhaust port shape and this relationship to the induction ports to achieve non interacting porting functions along with the lowest possible exhaust gas pumping losses.

Further performance enhancement features which improve the efficiency of combustion and improve fast burn are yet a further object of this invention. A first technique to improve the fast burn characteristic of combustion involves establishing a specific relationship between the location of the ignition source in the center power block relative to the position of the orbiting piston when ignition should occur. It has been found by extensive research that the ignition source should be located in a position which is directly centered within the combustion chamber cavity of the combustion chamber member at the instant ignition is instigated. A specific relationship between the phase angle of the orbiting piston and the ignition source location in the center power block is identified relative to the exact timing angle required for optimum combustion efficiency.

A second fast burn enhancement feature is the utilization of a separate alloy steel connecting bar in which two are required to connect the ends of the two CCM segments together. This bar is designed to operate at a high temperature to promote rapid evaporization and "on time" ignition to further enhance the fast burn characteristics of the MCC engine. A specific method of attachment to the CCM segments and the physical characteristics of this bar required to enhance combustion efficiency are disclosed.

It is thus a further intent to add these special features to allow even faster more reliable combustion and burning of various grades of fuels including low octane fuels in order to keep time losses very low in the quest to achieve higher thermal efficiency.

Accordingly, it is a further intent of this invention to provide certain improvements to the MCC engine in order to enhance its durability and improve areas of its design to providce a longer life, lower thermal stress and lower sliding forces between the sliding surfaces.

Particular importance in analyzing areas of concern dealing with durability, seems to focus on thermal related problems. Hence the first durability improvement disclosed in this invention is the incorporation of a method to mechanically distort the manifold relative to the rear power block of this engine to reduce the effects of differential expansion. It has been found that if the rear mounted manifold is hard mounted (screwed on tight) to the rear power block, a thermal differential condition will occur between the hot rear power block and the relatively cooler manifold. The reason this happens is that under operational conditions the manifold maintains a lower temperature due to the flow of cool induction mixture through it. On the other hand, the rear power block operates at a higher temperature due to the exposure to the high temperature of combustion on the other side. Therefore, if the manifold is tightly affixed to the rear power block a difference in expansion between the two components will cause the rear power block to bow in in the center. This inward distortion will tend to push the rear power block against the internal moving parts causing a high degree of friction and wear. Therefore a method to counter act the effects of this distortion is disclosed in this invention which will allow a low friction interface and improved durability.

A second item to improvement durability is also related to a thermal expansion problem. The Combustion Chamber Member (CCM) has an area which operates at a higher temperature than the rest of this part. This area is associated with and surrounds the CCM interface with the connecting bars. Since the connecting bars are now used as evaporator bars they are operating at a very high temperature. Since this thermal energy is absorbed into the CCM interface, the CCM can be modified by machining an area off each side of the interface point to eliminate a situation of the high expansion causing undo friction and wear at this point. Thus, a simple machined relief of this area is disclosed which when incorporated will enhance lower operating friction and yield an associated longer life.

Finally, disclosure of three items as manufacturing expedients is made a part of this invention.

The first disclosure intended to reduce the cost of manufacture, is the utilization of a one piece counter-weight hub which utilizes a longitudinal slot and clamping arrangement to fasten the hub securely to the crankshaft. The object of this invention is to provide a combination of features within one single item to help economize the cost of the engine. Instead of providing separate counterweights, each attached separately to the crankshaft, this invention combines two independent counterweights which incorporates them into a single part together with a unique method of clamping the entire unit to the end of the crankshaft. U.S. Pat. No. 5,341,774, FIG. 2 shows a one piece counterweight hub with the location of the integral counterweights 20 and 21. However, this invention discloses how this single unit can be improved to contain a slot and clamping arrangement to align and securely fasten this part to the crankshaft in order to provide an important cost saving feature to the manufacture of the MCC engine.

A second cost saving feature to be disclosed is a one piece induction and exhaust manifold. The object of this invention is to combine the induction tract necessary to supply the carbureted mixture into the induction ports of the engine together with an exhaust tract which is necessary to channel the exhaust gases from the exhaust port out to an exhaust hose or conduit, all into one integrated part. Other desirable features of this one piece integrated unit will be disclosed which also point out certain thermal and sealing advantages. However, as a one piece unit which combines two important functions into one part, it's one significant advantage is its cost savings' impact on the MCC engine.

A final manufacturing expedient is disclosed which utilizes independent wear strips placed inside the center power block to provide the necessary sliding support and sealing surface for the CCM. The object of this invention is to manufacture the center power block as a one piece unit where in the high manufacturing cost of providing an ultra flat - hardened surface inside the power block for the CCM to slide on is replaced by much cheaper wear strips which are inserted into the center power block. These wear strips can be prepared as flat precision parts much easier and with far less cost by making them in large quantities on standard machines outside of the engine's power block.

Accordingly the intent of this invention is to describe a number of very important enhancement features. Some of these are disclosed to improve performance, others are disclosed to improve durability and cost of manufacturer; but more importantly all of these features are disclosed for the reason that these features are being incorporated into the current MCC engine design which will be manufactured and sold as a viable alternative and competitive engine.

These features and objects of the present invention will be more clearly understood from a perusal of the following detailed description read in conjunction with the accompanying drawings in which:

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENTS

Figure 1:
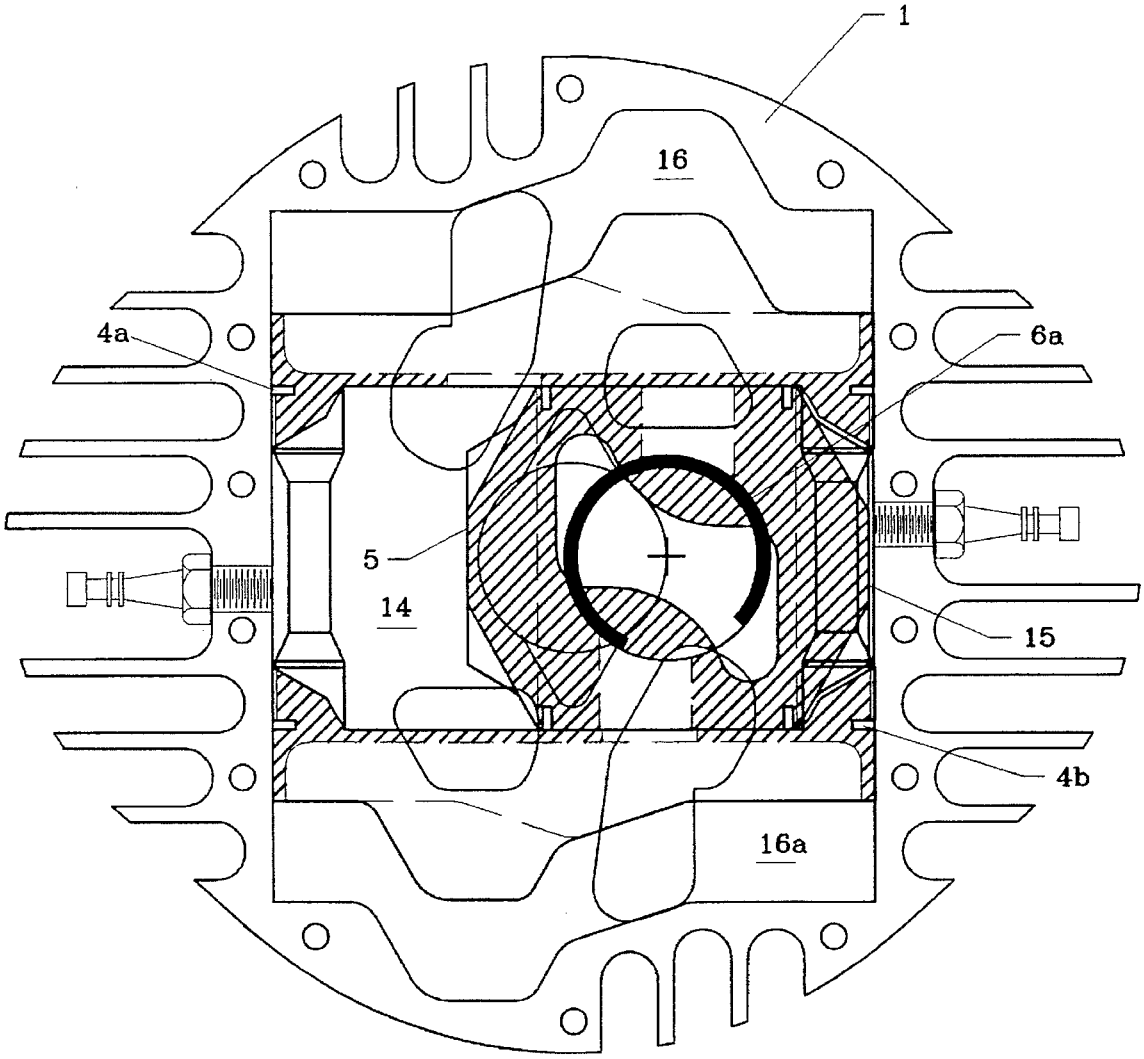
FIG. 1 is an internal section view of the full expansion variant of the MCC engine mechanism.
Figure 2:
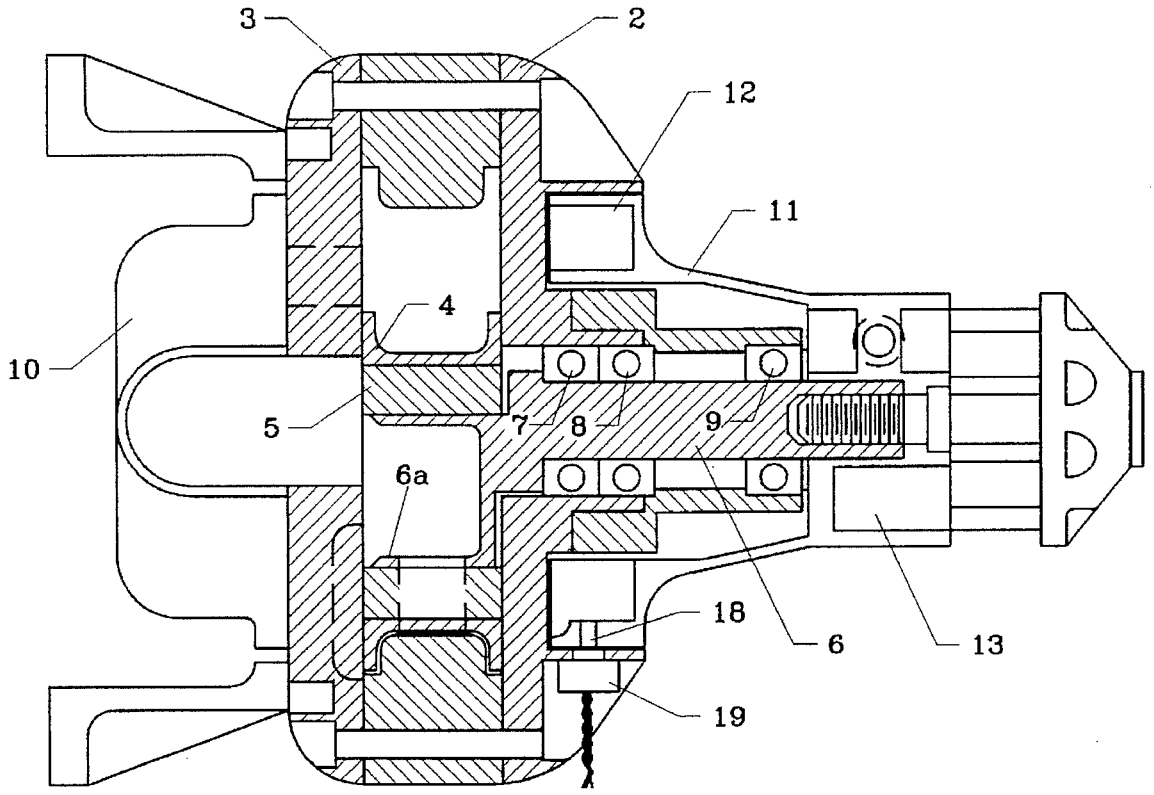
FIG. 2 is a longitudinal section view of an overhung crankshaft version of the MCC engine mechanism.

In FIGS. 1 and 2 there is shown the full expansion variant of the MCC internal combustion engine mechanism having a stationary power block housing formed of a center power block 1 and front and rear power block 2 and 3, a combustion chamber member 4, an orbiting piston 5, a crankshaft 6 and bearings 7, 8 and 9 which provide rotatable support for said crankshaft. Other notable features of this engine include a combination exhaust and induction manifold 10 a single piece counterweight hub 11 which contains counterweights 12 and 13.

As in my prior U.S. Pat. No. 3,630,178, as the crankshaft: eccentric 6*a* rotates, the combustion chamber member 4 executes a vertical reciprocating motion as viewed in FIG. 1 while the orbiting piston 5 executes a horizontal reciprocating motion relative to the combustion chamber member 4. The combined effect of these motions results in a circular motion of the orbiting piston 5 with the eccentric 6*a* of the crankshaft 6 about the center line of the crankshaft. Thus, the combustion chambers 14, and 15 experience not only a change in size, but a change in location as well. The chambers 14 and 15 migrate. The orbiting piston 5 acts as the primary power piston for the crankshaft and is connected thereto through a rotary bearing. The orbiting piston 5 is driven directly by the alternating combustion forces applied to opposite faces of the piston from the pair of combustion chambers 14 and 15 located on opposite sides of the piston. The combustion chambers are located within the combustion chamber member (CCM) 4 and bounded by heads (also referred to as power blocks) 2 and 3 on opposite ends. While the migrating combustion chambers are located within the CCM, there are also fixed location, variable volume chambers 16 and 16*a* formed outside the CCM which may be utilized to act as secondary expansion chambers. The crankshaft supports a magnet 18 which energizes a sensor 19 each time it passes to provide basic engine ignition and/or fuel injector timing. As a further clarification of how the basic moving parts relate to each other, refer to FIG. 3. Note that the crankshaft eccentric 6*a* fits into and rotates inside the orbiting piston 5 and thus provides the piston with true orbital motion. Also, since the piston 5 fits into and is free to slide back and forth in the combustion chamber member (CCM) 4 it causes the CCM to reciprocate up and down inside the center power block 1 as shown in FIG. 1. Additional clarification of how the full expansion variant of the MCC engine functions refer to U.S. Pat. Nos. 4,325,331 and 4,437,437 which describe its cycle of operation and how this cycle is carried out utilizing the MCC engine mechanism.

Figure 3:
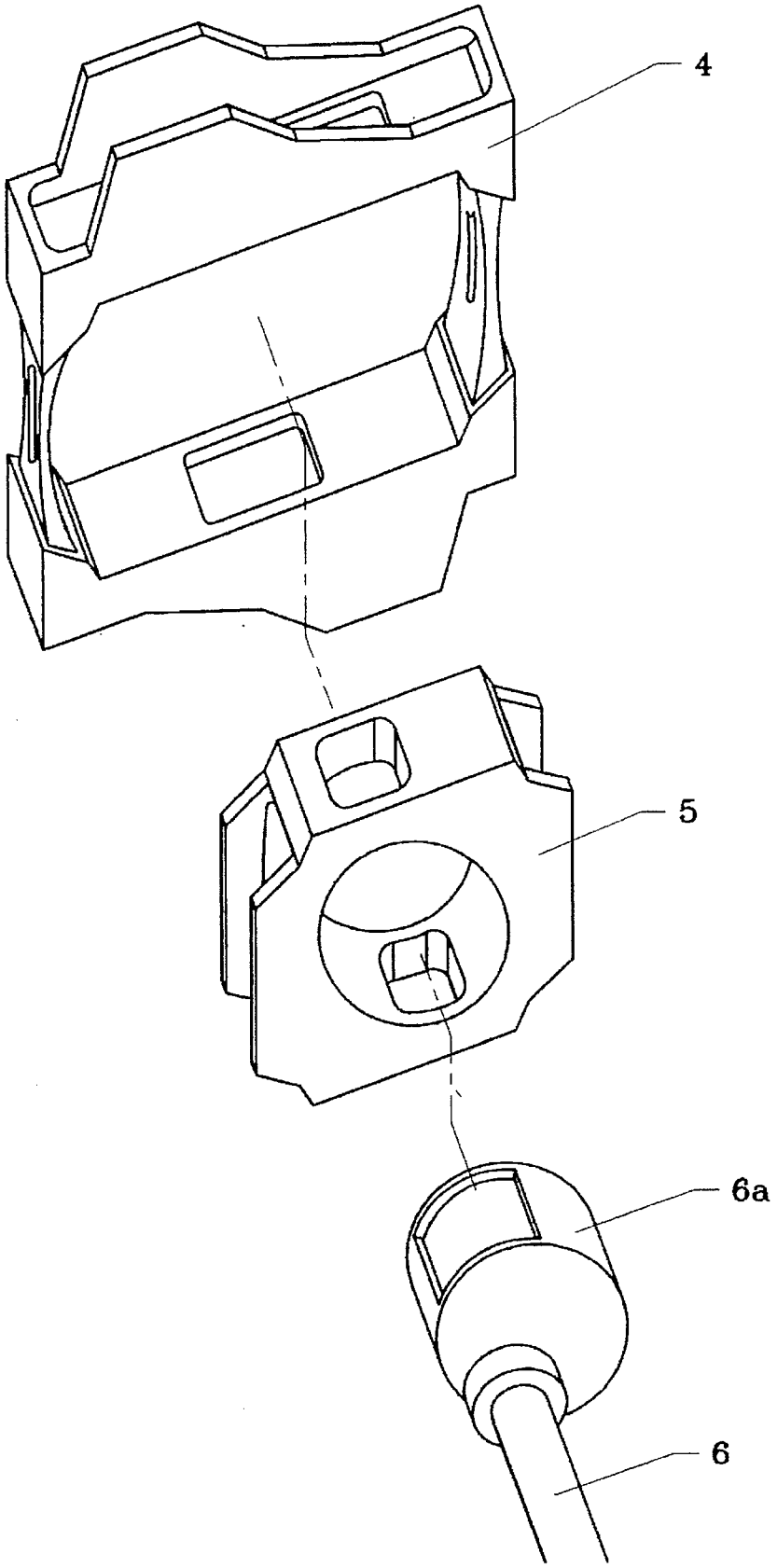
FIG. 3 shows an exploded perspective view illustrating the combustion chamber member (CCM), orbiting piston (OP) and crankshaft relationship of this invention.

The present invention encompasses a number of unique features relating to improvements to enhance the performance, durability and manufacturability of the Migrating Combustion Chamber (MCC) engine. Although FIGS. 1, 2 and 3 illustrate the full expansion variant of the MCC engine in which most of the disclosed improvements are directly applicable, the features which relate only to the basic MCC mechanism also apply to the supercharged two stroke variant of the MCC engine as described in U.S. Pat. No. 5,341,774 as well. The first features of this invention relate to improvements to enhance performance.

Figure 4:
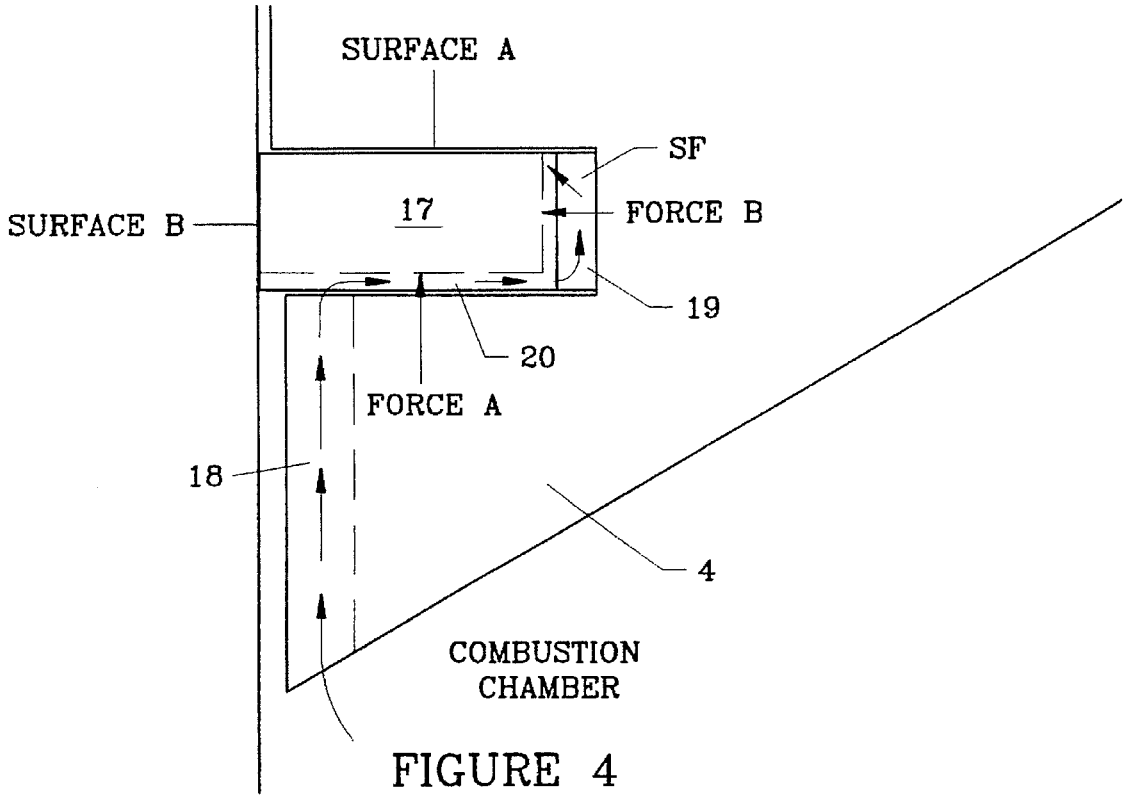
FIG. 4 is a cross section view of a strip seal design illustrating passage ways to promote sealing by combustion pressure.
Figure 6:
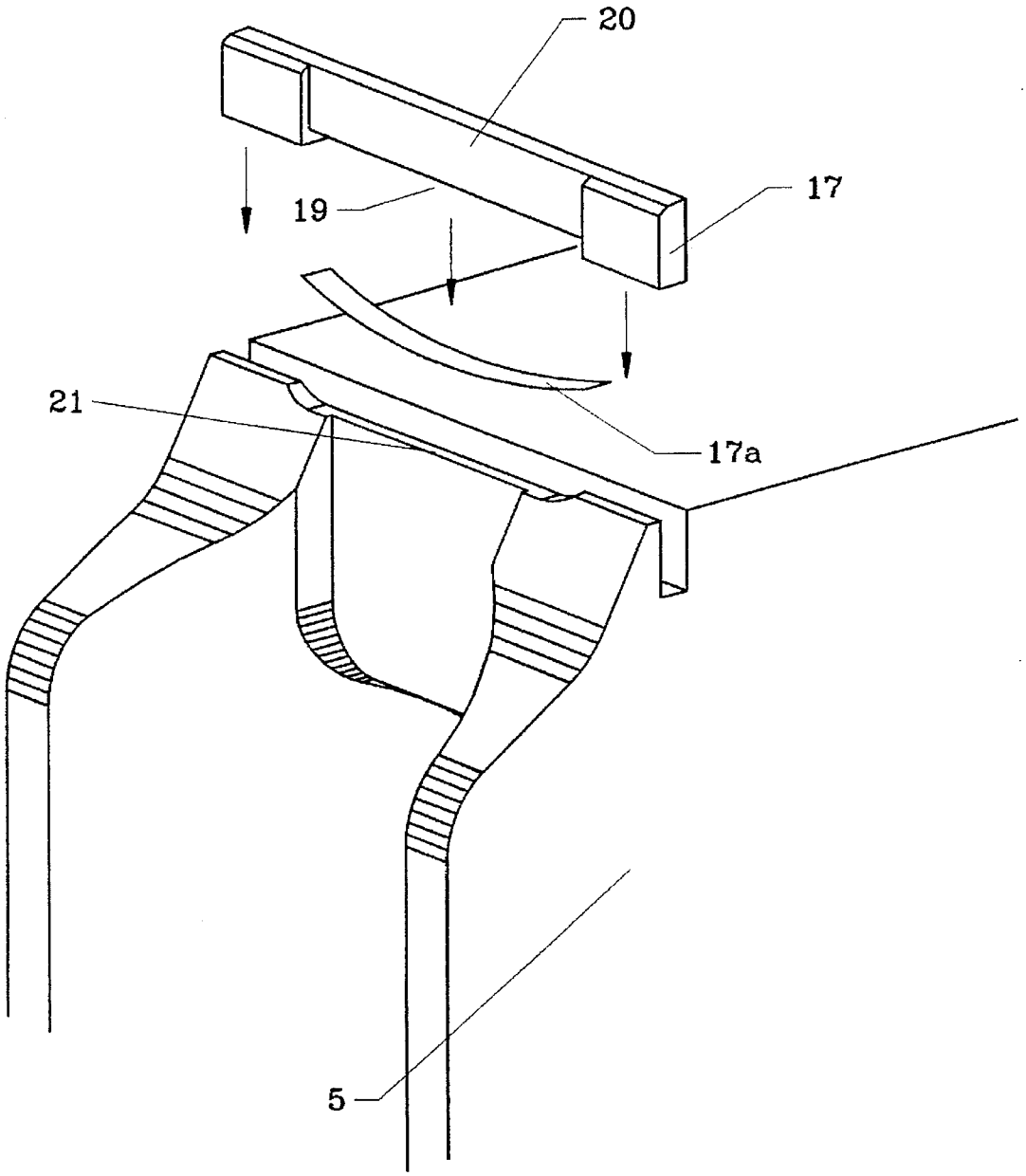
FIG. 6 illustrates a three dimensional view of a typical seal and orbiting piston with its slot to receive the seal.

FIG. 4 depicts a cross section view of a strip seal design which has been developed to exhibit excellent sealing qualities to enhance performance of the MCC engine throughout a wide range of speed and load conditions. The novelty of this invention resides in the provision of passageways or pressure conduits to enable the seal 17 to be adequately "pressure backed" and to assure almost leak free retention of the high pressure combustion gases. A simple single curved spring 17*a* (FIG. 6) provides an initial force to keep the seal 17 in contact with the sealing surface. This spring 17*a* is only strong enough to counteract any centrifugal forces trying to pull the seal away from the sealing surface. Once the combustion pressure reaches the seal, the force provided by the combustion pressure will be high enough to ensure the seal will contain the combustion pressure inside the combustion chamber. However, two surfaces of the seal must be acted upon by the combustion pressure to insure proper sealing is maintained. Again, in reference to FIG. 4 it is illustrated that the pressure from the combustion chamber is first routed through a passage 18 in the end of the combustion chamber member 4, and then through a passageway 20 under the seal itself to reach the area 19 directly behind the seal. Notice in FIG. 4 that the pressure from combustion which is routed under and in back of the seal provides two forces A and B applied directly on the seal. The first force A pushes up on the seal to form a surface to surface contact and seal with surface A of the seal slot. The second force B pushes the seal to the left against surface B to form a surface to surface contact and seal with the sliding contact surface B. It is very important to establish a good seal between each of these two sealing surfaces in order to retain the high pressure combustion gases inside the combustion chamber since the high pressure could otherwise escape directly past the seal around surface A or surface B if the seal did not adequately contact and seal against each of these surfaces.

Figure 5:
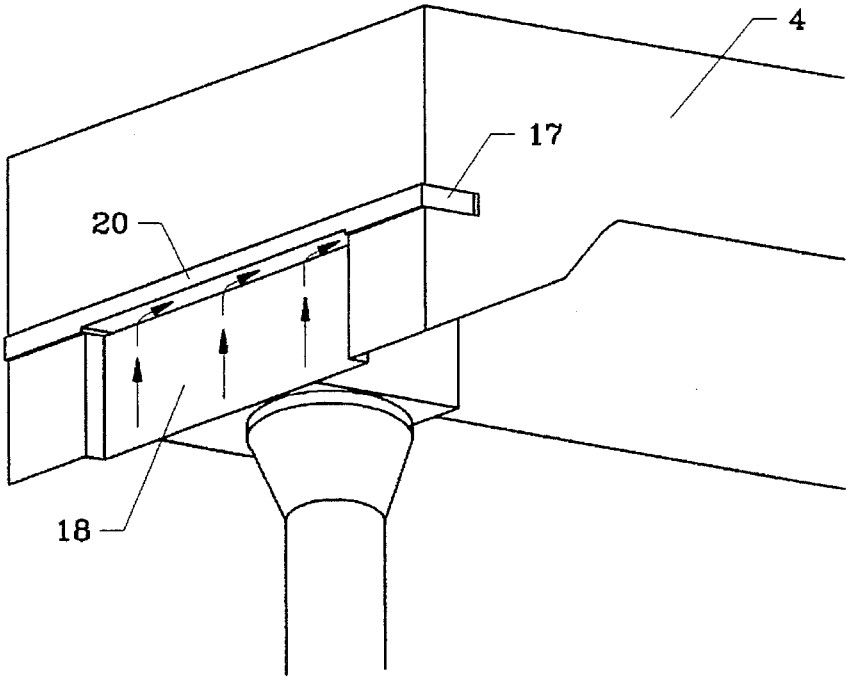
FIG. 5 illustrates a three dimensional view of a typical seal nesting in the seal slot of the combustion chamber member.
Figure 8:
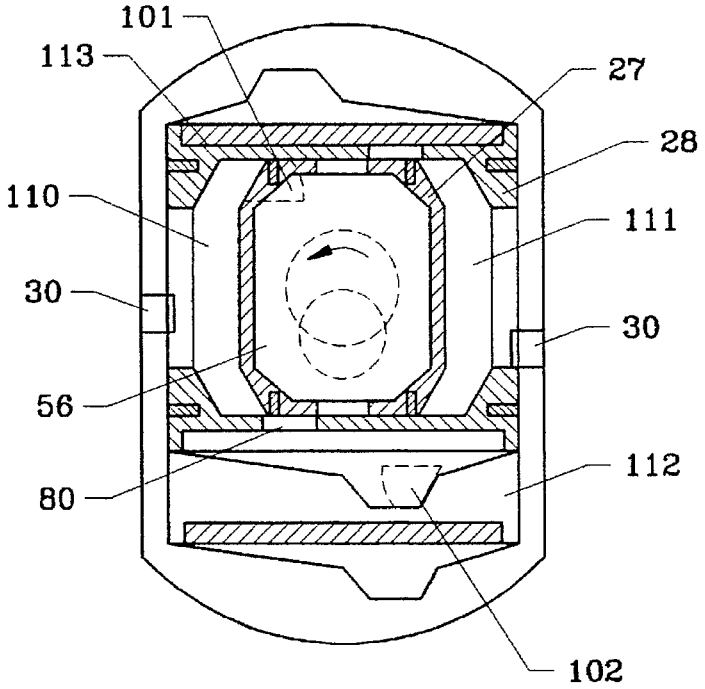
FIGURE 8 (PRIOR ART)
FIG. 8 illustrates how the prior art method does not allow completion of the transfer of gases until the induction port is just closing.

FIG. 5 illustrates a three dimensional view of the seal 17 nesting inside of the CCM seal slot. Note, the undercut or passage 18 in the CCM which first channels the combustion pressure into the undercut passageway 20 of the seal to gain access to the rear area 19 of the seal. This combination of passageways provides the necessary pressure backing of the seal as previously described. To further illustrate the importance of the passageways to assist channeling the pressure into the seal slot refer to FIG. 6. Note in FIG. 8 that the seal 17 when placed into the seal slot of the orbiting piston 5 that the passageway 21 in the piston allows the combustion pressure to again enter the passageway 20 on the side of the seal and also the passageway 19 on the underside of the seal.

Thus, the seal design of this invention utilizes two passageways incorporated into the seal itself in concert with a passageway in the moving member which contains the seal. Said passageway in the moving member is located between the seal and the open volume of the combustion chamber. This passageway directs the pressure of combustion to act on two areas of the seal to provide a gas tight seal between the moving member and the stationary sealing surface which the seal is in sliding contact. Seals such as just described may also be employed to form a seal between the migrating combustion chamber and the sidewalls of the stationary power block housing as illustrated 4*a* and 4*b* in FIG. 1.

It is a further intent of this invention to provide improved fuel efficiency. A method incorporating a change in the way the expansion gases are ported and timed to transfer from the combustion chamber into the secondary expansion chamber is disclosed. This porting method basically reduces the amount of wasted mixture into the secondary expansion chamber during the exhaust collection portion of the cycle.

Figure 7:
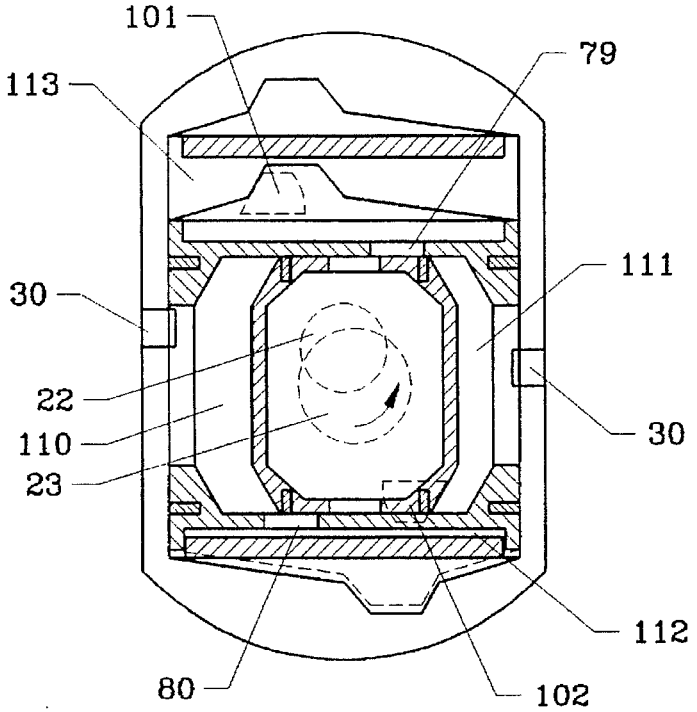
FIGURE 7 (PRIOR ART)
FIG. 7 is a view of the prior art method of symmetrical port timing used to transfer the combustion gases into the secondary expansion chamber.
Figure 9:
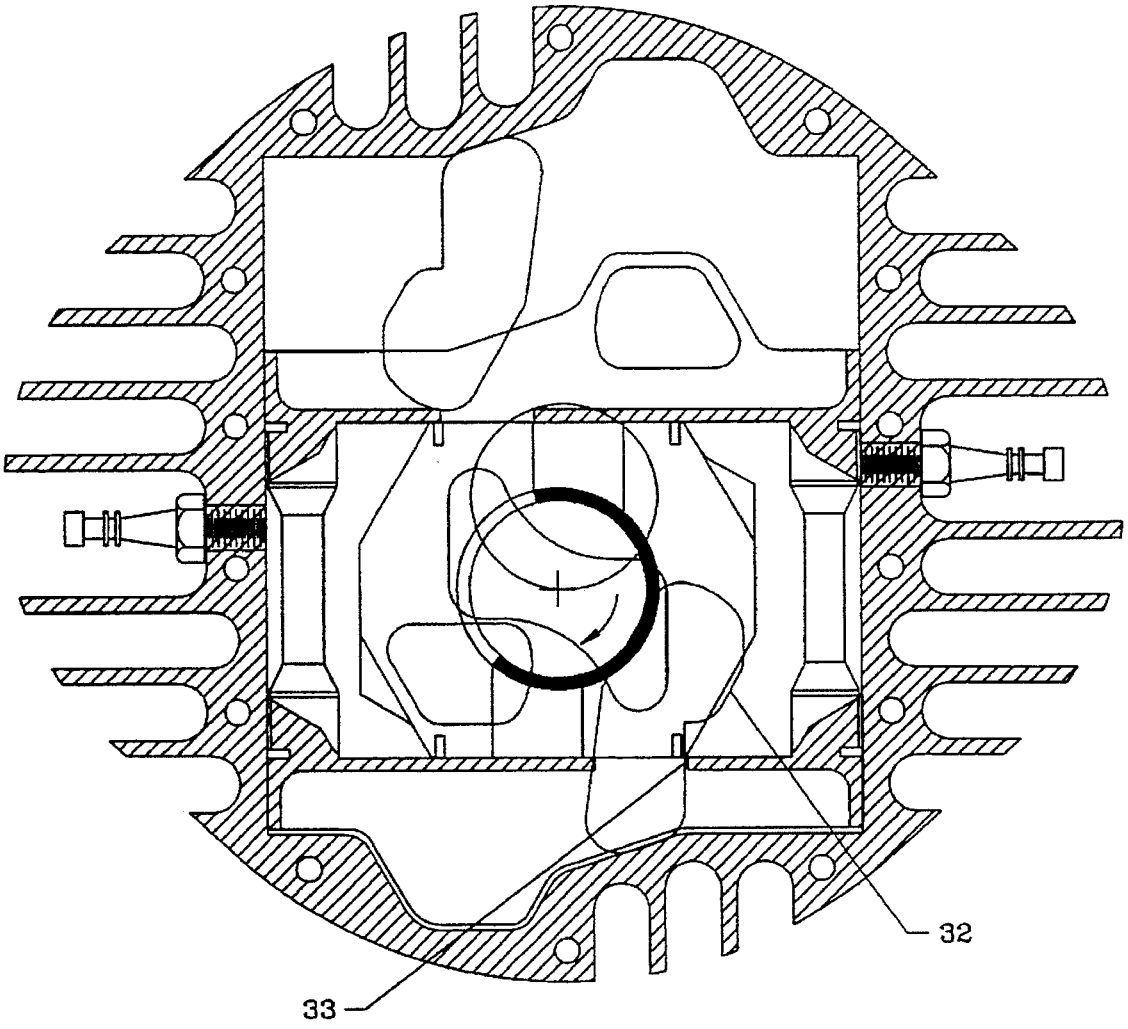
FIG. 9 shows the combustion chamber member transfer port opens at the same time as the side transfer port opens.
Figure 10:
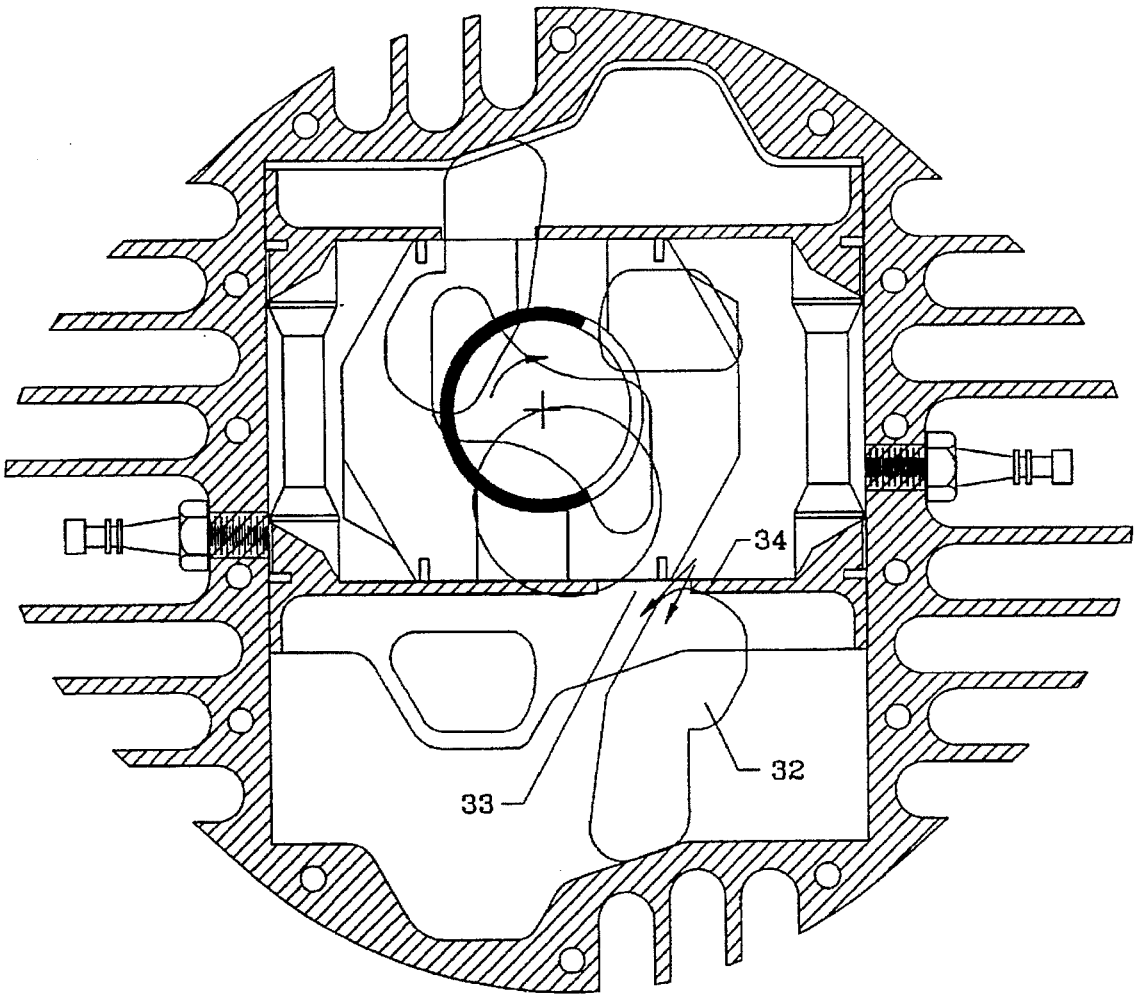
FIG. 10 shows the combustion chamber member transfer port closing after the side transfer port closes.

U.S. Pat. No. 4,437,437 describes the full expansion engine as utilizing a port through the combustion chamber member which is uncovered by the orbiting piston (OP) to allow the secondary expansion to take place. This arrangement is very simple and works will. However, due to the symmetrical port timing characteristics of this porting arrangement this port must remain open until the orbiting piston is closing the induction port to begin the compression phase of the cycle. During the latter half of the induction process, some induction gas will escape into the secondary expansion chamber due to the required late closing of the CCM bypass port. Refer to FIG. 7 (a reprint of FIG. 35 of U.S. Pat. No. 4,437,437 illustrating prior art). FIG. 7 shows that during the normal method using port 80, the cycle has Just begun to transfer the high pressure combustion gases into the secondary expansion chamber 112. Also, note from FIG. 8 (a reprint of FIG. 40) that this port 80 does not close until the induction port 101 is just closing. This illustrates that some induction mixture can be lost to the lower chamber during the last portion of the induction phase of the cycle since the transfer port 80 does not close until the lower expansion chamber 112 reaches its full open volume. Under this condition of part load operation, chamber 112 will provide too much volume for storing the exhaust gases generated during the combustion and expansion process. Therefore a partial volume at sub-atmospheric conditions will be available for sucking in some of the induction gas before the ports close. The intent of this invention is to utilize non-symmetrical porting located in the front and rear power blocks to significantly reduce the amount of inducted mixture into the secondary chamber. These side ports can be opened at an angle $\beta$ after top dead center position of the orbiting piston which may be the same time the prior art CCM ports are opened, but they can be timed to close much earlier (at an angle $\beta+\mu$ before top dead center position of the orbiting piston) than the CCM ports to prevent the last portion of the induction gases from being lost into the secondary expansion chamber. FIG. 9 illustrates how the side port 32 can be opened at the same time as the CCM port 33 to begin the secondary expansion process. However, note in FIG. 10 that side port 32 has just closed, due to the upward motion of the CCM edge 34, ending any possibility of collecting induction gases past this point into the lower expansion chamber. Also, note (for reference purposes) that the CCM port 33 is still open to promote the undesirable entry of the induction gases into the lower chamber. Laboratory tests have shown that a significant increase in fuel economy is possible utilizing the non-symmetrical opening and closing features of the side ports compared to the CCM ports for accomplishing the secondary expansion process.

A further intent of this invention is to reduce internal pumping losses during the exhaust Gas extraction stroke of the full expansion variant of this engine. Normally the exhaust gas extraction portion of this cycle begins immediately after the secondary expansion chamber has sucked the exhaust gases into the secondary expansion chamber after completing the secondary expansion function of the cycle. (Refer to U.S. Pat. No. 4,437,437 columns 13, 14 and 15 and FIGS. 35 through 40 for an explanation of the specific details of the disclosed prior art method of collecting the exhaust gases into the secondary expansion chamber 112.)

The basic method of extracting these exhaust gases is by pumping them out as the secondary expansion chamber is decreasing in volume by the communication of a port in the orbiting piston with a port in the CCM. These ports align so that exhaust gases are pushed out of the expansion chamber and into the center of the orbiting piston and then out through an exhaust manifold centered in the rear power block. In referring to FIG. 11 the timing of these two ports (in the OP and CCM) is such that they just begin to communicate as the secondary expansion chamber begins to decrease in volume (CCM at bottom center) and they terminate communication just as this volume reaches it minimum condition (CCM at top center). Due to the fact that these ports provide symmetrical timing, they are constrained to open when the CCM is at its bottom center position. Conversely, also due to the symmetrical timing relationship these ports are required to close at exactly the CCM top center position as dictated by the point at which the secondary expansion begins. Under all part load conditions a vacuum is formed in the secondary expansion chamber as it approaches its fully open position due to the throttling losses caused by the part load condition. Therefore, the combination of the exhaust port opening together with this sub-atmospheric condition, actually causes an in-rushing of the already ejected exhaust gases back into the secondary expansion chamber during the early part of the exhaust extraction phase of the cycle. This represents a pumping loss since the gases that reenter this chamber must be pumped back out along with the exhaust gases that have already been collected in this chamber.

Figure 11:
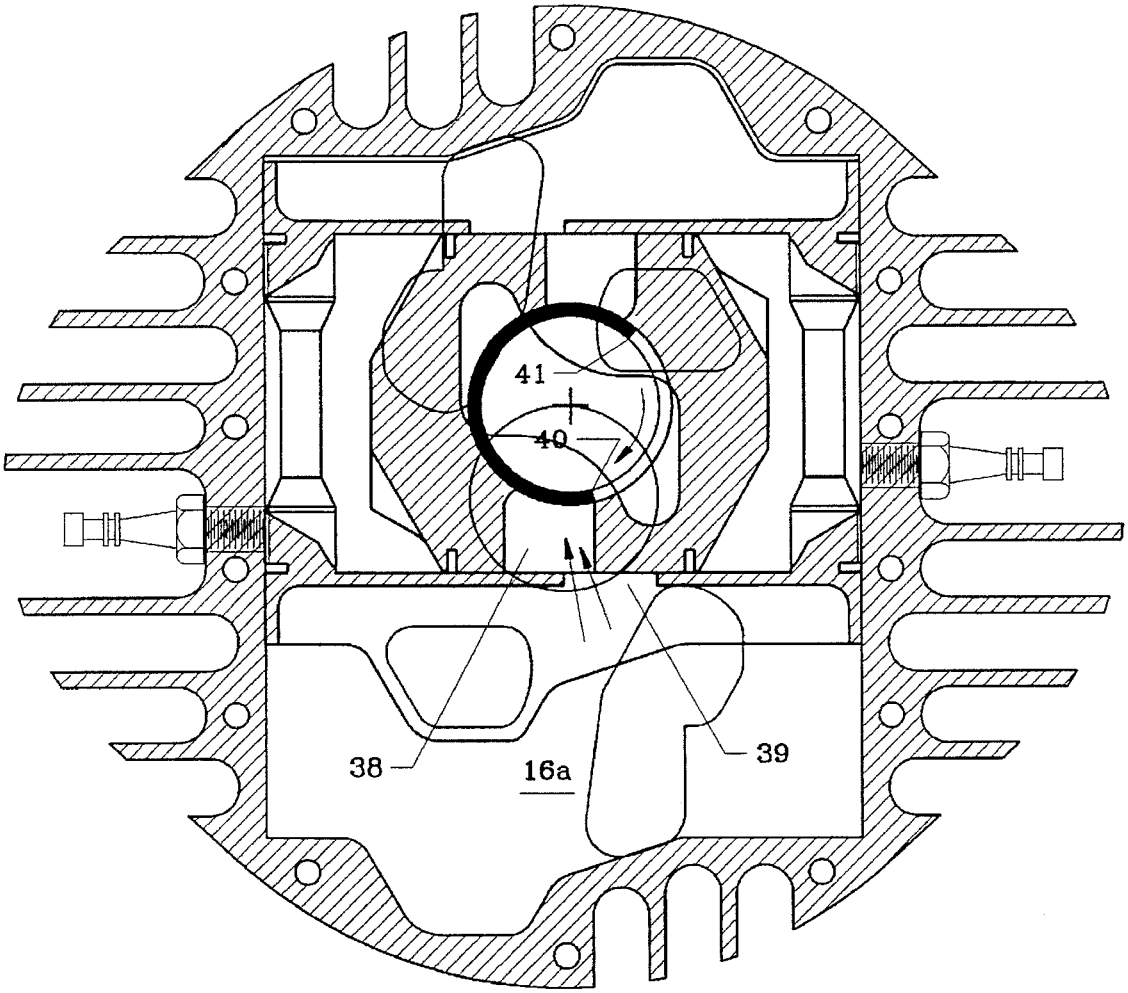
FIG. 11 illustrates incorporation of a rotary valve can delay the opening of the exhaust track to reduce pumping losses.
Figure 12:
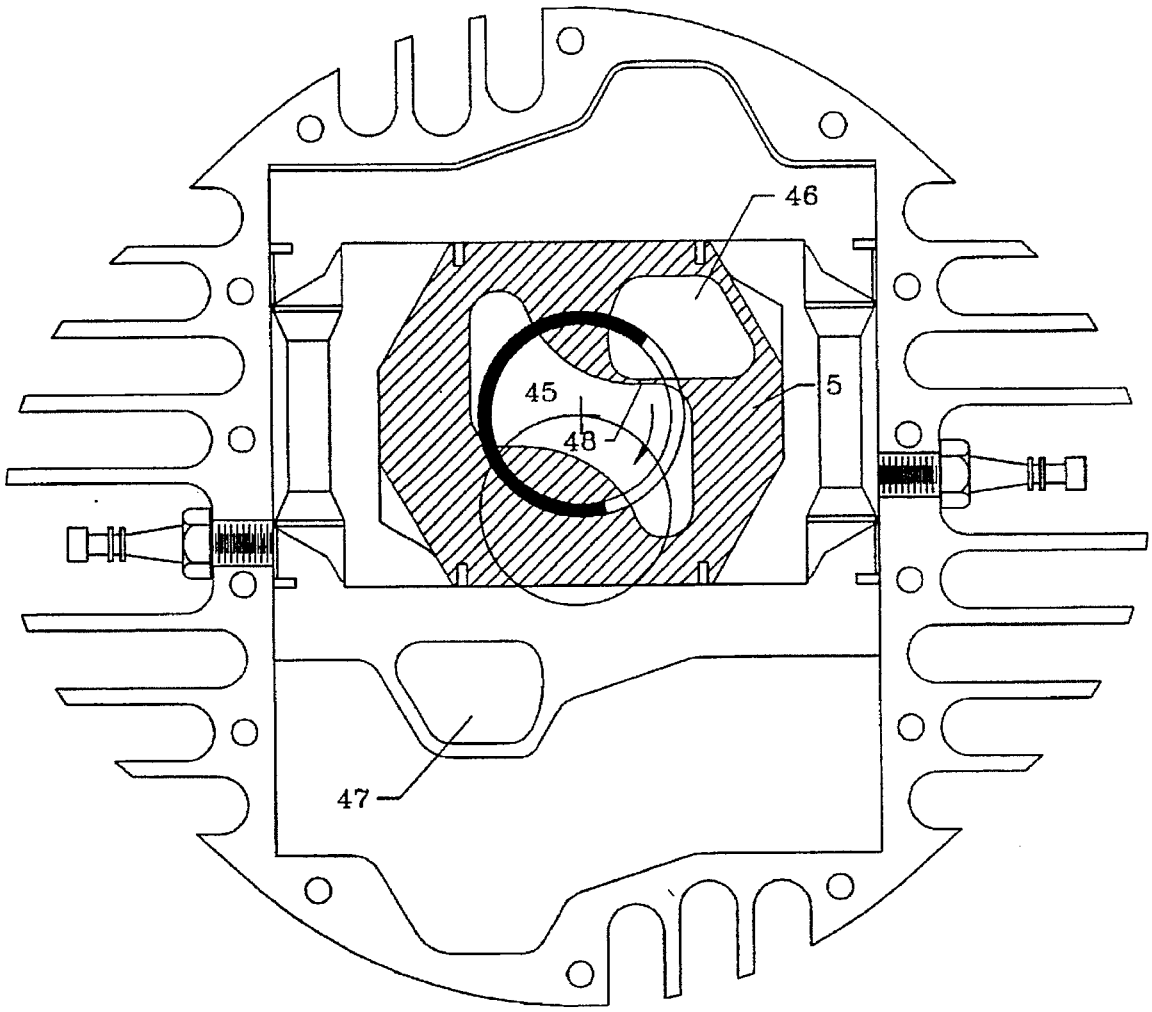
FIG. 12 illustrates a specific profile of the exhaust port in the orbiting piston to maximize port area without overlapping the induction ports.

A method to eliminate this loss is the object of this invention. A rotary valve will be utilized as part of the eccentric crankshaft which rotates in the orbiting piston. This valve is ported to provide a method of delaying the opening of the exhaust tract through the CCM and OP. This delay will eliminate the reentry of a portion of the previously spent exhaust gases back into the secondary expansion chamber during the initial part of the exhaust function. Refer to FIG. 11 which illustrates that normally, the exhaust Gas is forced out through ports 39 in the CCM and 38 in the OP from the lower chamber 16*a* as this chamber is decreasing in volume. However, note that the opening of the exhaust route to the center of the OP can be delayed by incorporating a rotary valve with an opening edge 40 just beginning to open port 38 from the inside center. This delayed opening keeps the previous exhaust gas from reentering chamber 16*a* until the volume in chamber 16*a* has been decreased enough that a positive pressure is beginning to be developed. A secondary benefit derived from delaying the exhaust port opening is that any vacuum occupying the lower chamber 16*a* as it passes its bottom center position adds a slight turning moment benefit which adds a positive torque to turn the engine's crankshaft, A further object of this invention is to further reduce pumping losses during the exhaust gas ejection process. A decrease in back pressure of the ejected exhaust gases can be realized by providing the largest possible exhaust port area through the back side of the piston. This is possible by defining the limits of the porting hole in the back side of piston so that porting area can be maximized without allowing any undesirable overlap of the exhaust opening with the induction ports. FIG. 12 illustrates that as the piston 5 moves through its orbital path, its exhaust port 45 has a specific shape around its perimeter to never allow any area inside its perimeter to overlap either of the two induction ports 46 and 47. Note that the shape of the exhaust port is similar to a double boot in which the boots are connected at the ankle with either boot being disposed at an angle of 180° with the other. Also, note that each edge of the OP exhaust port (from the heal of one boot blending into the toe of the other) is selected so that there is always a small distance 48 between the exhaust port and the induction ports on each side as the exhaust port moves through its orbiting path. The specific shape of the exhaust port is thus selected so that there is always a minimum fixed distance 48 between the exhaust port and each of the two induction ports as the piston moves around in its orbital path.

Figure 13:
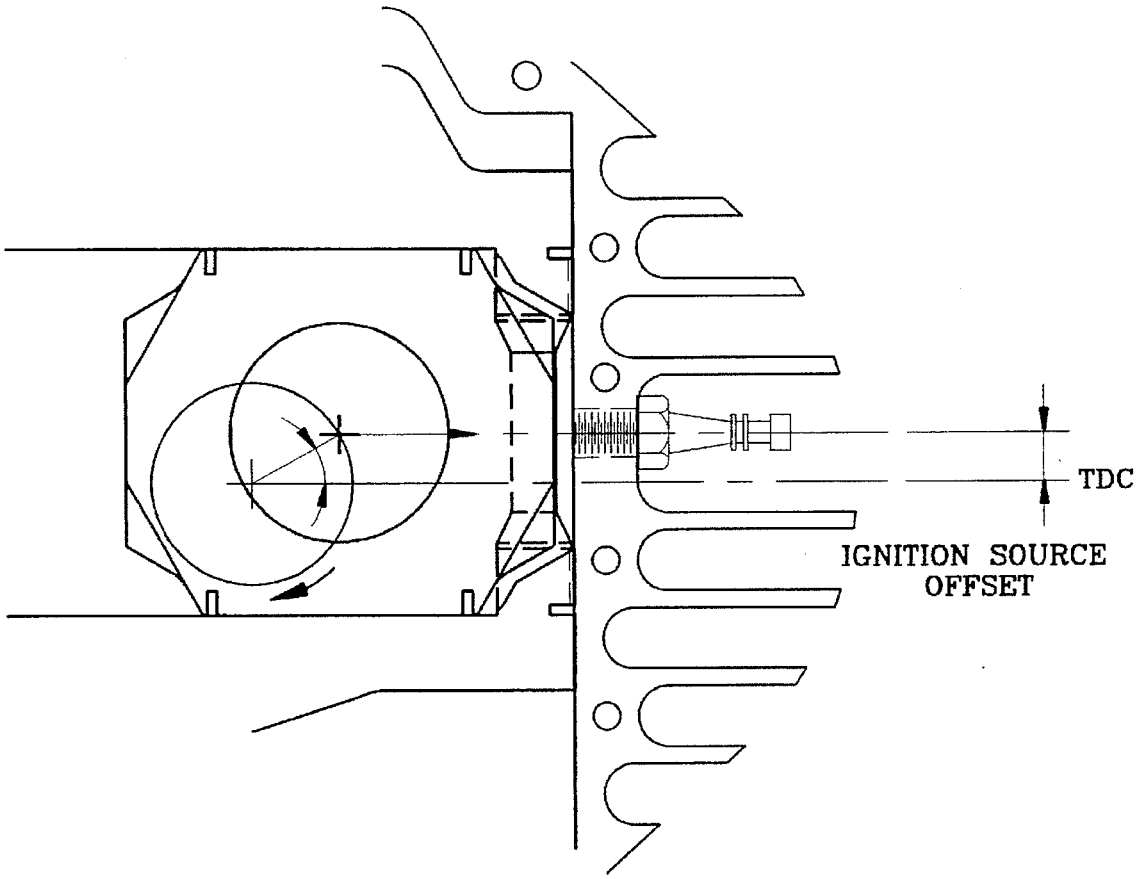
FIG. 13 is a diagram of the position of the combustion chamber member, orbiting piston and ignition source for obtaining maximum combustion efficiency.

The fast burn enhancement feature will now be described which allows an increase in performance due to a reduction in combustion time losses. A first fast burn enhancement feature is to locate the ignition source (i.e., spark plug, glow plug, etc.) in a specific location of the center power block to allow the lowest possible combustion losses to occur. It has been found that to achieve the optimum and economical ignition point, the ignition source must be located in the center power block in a location that will be centered relative to the Migrating Combustion Chamber at the point ignition actually occurs. Therefore, if it is desired to achieve ignition at a certain point before top dead center (TDC) then the ignition source must be located at a point in the center power block which is upstream of the TDC position by an amount equal to the crank radius times; the sin of the ignition advance angle. Referring now to FIG. 13 it is shown, for example, that if the ignition advance angle is 30° and the crank radius R is two inches, then the location of the ignition source will be R sin 30° or $2\times0.5=1\Delta$ upstream of the TDC location in the center power block. This feature will ensure the most economical operation is achieved since the center of the combustion process should always begin in the exact center of the Migrating Combustion Chamber even though the combustion chamber is in continuous movement relative to the ignition source at all other times in the cycle. Therefore a further object of this invention is to define a specific location for the ignition source in order to optimize combustion efficiency.

A second fast burn enhancement feature incorporates a round metallic CCM connecting bar which is configured to enhance combustion efficiency. This bar is the connecting link between the upper and lower segments of the CCM. Unlike previous designs which utilize a one piece CCM with integral connecting bars, these bars are separate pieces which are made of an alloy steel, or high nickel content alloy to provide a very hot means to help evaporate the fuel mixture by being positioned in the center of the combustion chamber as it approaches it's TDC position. This centralized position allows the bar to act as an evaporator due to its very hot temperature to assist in the rapid evaporation and ignition of the fuel mixture as the mixture surrounds the bar in its highly turbulent state. This very high thermal interface between the not yet vaporized fuel droplets and the hot evaporator connecting bar will ensure even faster burn due to the rapid heat transfer from the evaporator connecting bar to the highly turbulent fuel mixture.

Figure 14:
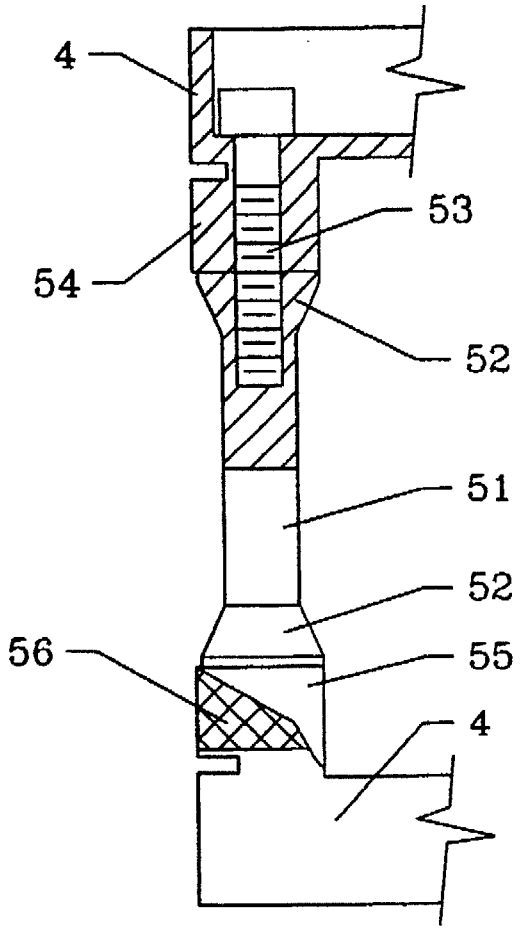
FIG. 14 illustrates a separate connecting bar affixed to each end of the combustion chamber member segments and utilized as an evaporator to enhance fast burn.

The construction of these connecting bars is illustrated in FIG. 14. Previous connecting bars used in the prior art engine designs (refer to U.S. Pat. Nos. 4,437,437 and 5,341,774) were an integral part of the CCM in which the entire CCM was made of the same material. However, it has been found that if these bars are made as separate pieces out of an alloy which can with stand high temperatures, they will contribute to faster burn if they are located in the approximate center of the compressed mixture during ignition and combustion. Referring again to FIG. 14, note that the design of these separate bars is very simple and straight forward, only requiring a screw 53 threaded into each end 52 of the connecting bar. A cross section view of the upper portion of the connecting bar and the upper CCM segment 54 illustrates that the bar can be flared out on each end to provide a better heat sink and more stable connection to the CCM segment. The center portion of the connecting bar 51 is smaller in diameter in order to operate at a higher temperature to enhance its fast burn advantages.

In operational tests it has been found that this hot evaporator bar will not contribute to pre-ignition problems due to the very turbulent mixture flow around the bar. This high turbulence is the primary reason that fast burn is accomplished once ignition is completed.

In operational MCC engine testing, the combustion chamber temperature is routinely set at 440° F. without any indication of pre-ignition or detonation occurring while utilizing the hot evaporator bar to enhance fast burn. Yet it is a further objective of this invention to utilize separate connecting bars to operate as evaporators to enhance fast burn to obtain higher combustion efficiency.

Figure 15:
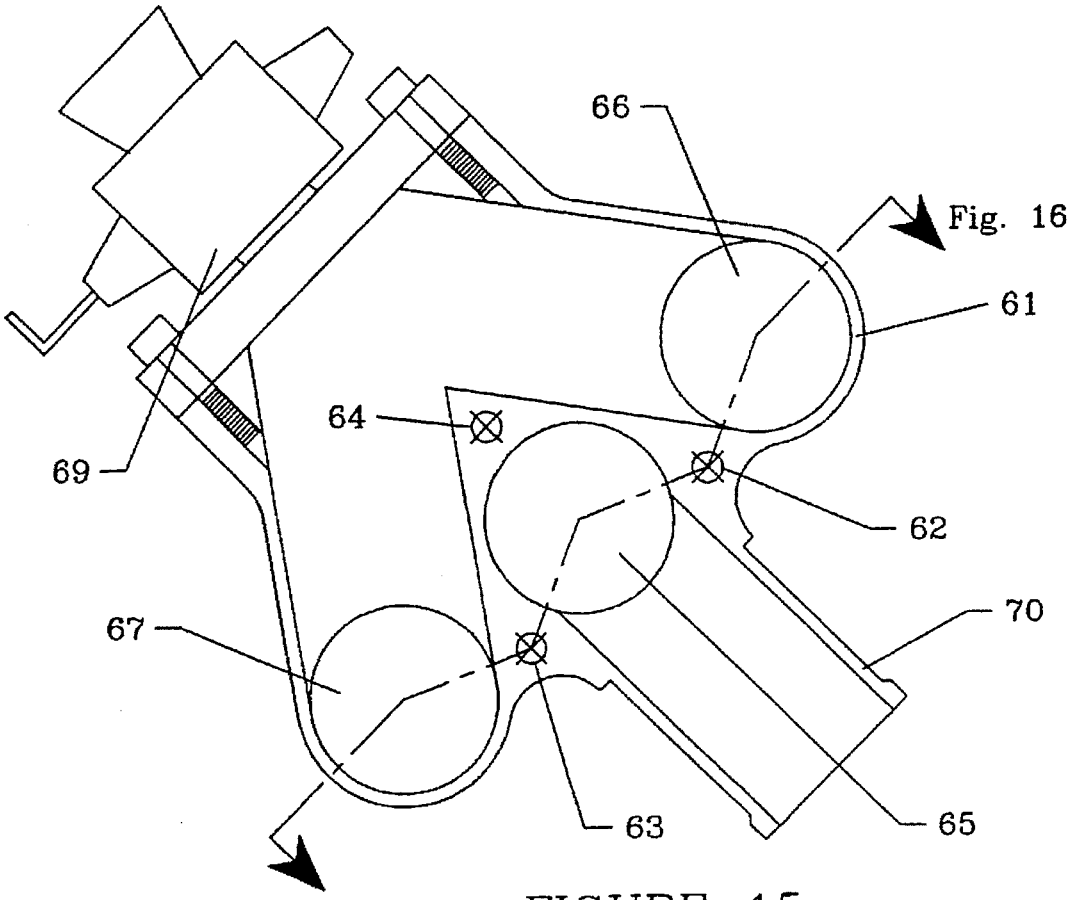
FIG. 15 shows a one piece manifold and rear power block with a pre-stress condition therebetween which can correct a distortion problem and avoid a high friction condition.
Figure 16:
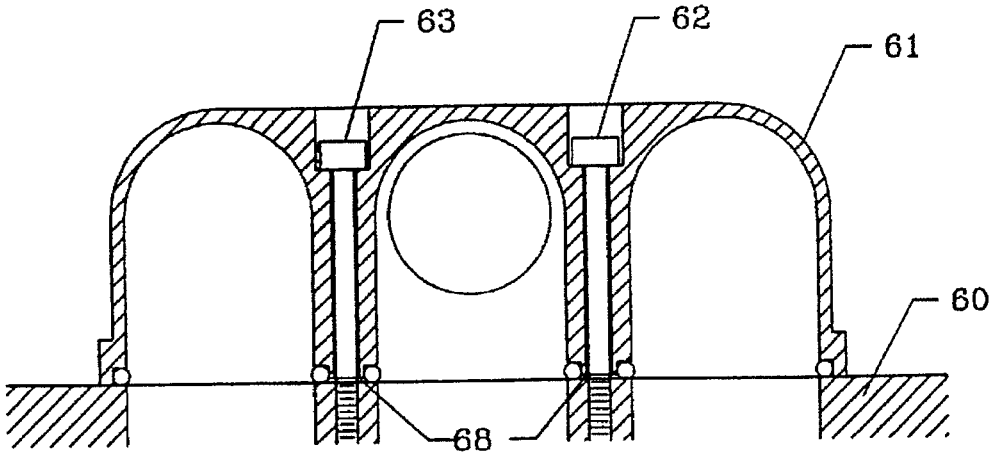
FIG. 16 is a cross section view of the one piece manifold of FIG. 15 as hard mounted to the rear power block.

A first feature to enhance the durability of the MCC engine is to provide a method of limiting the effects of differential expansion between the cool induction manifold and the much hotter rear power block due to the manifold being hard bolted to the rear power block. This hard connection causes an inward distortion against the moving mechanism which in-turn causes a high degree of friction and wear between the rear power block and the moving mechanism. This distortion is a result of the rear manifold being hard mounted (screwed on tight) to the rear power block. This situation causes a differential condition to exist between the hot rear power block and the relatively cooler manifold. This in turn causes the rear power block to distort inwardly due to the bi-metal effect of the cool manifold and hot rear power block as the engine is obtaining a stabilized operating temperature. The object of this invention is to incorporate a method to limit the effects of this differential expansion so that friction between the rear power block and the mechanism is maintained at a low level to enhance durability. It has been found that if the manifold is secured to the rear power block in a manner which applies a reverse direction distortion to the rear power block (a slight bow out) then, when the engine is running at a stabilized temperature, the combined differential expansion effect will be to bow in the power block to a point in which the inside surface is again flat. To accomplish this refer to FIG. 15 and 16. FIG. 15 is a view looking down on top of the manifold in which the three screws 62, 63 and 64 attach the manifold to the rear power block. Also shown is an exhaust tract port 65 and induction tract ports 66 and 67. Notice that the three attachment screws are all clustered around the center of the manifold. FIG. 16 is a cross section view of the manifold which illustrates two of the attachment screws 62 and 63 and also shows the three o-rings which seal the ports between the manifold 61 and rear power block 60. The method by which a reverse distortion is obtained for the rear power block is to tighten the three screws 62, 63 and 64 until the very small clearance 68 in the center of the manifold is reduced to zero (for a line to line contact) between the manifold and rear power block. This forced distortion will pre-stress the rear power block to bow out a slight amount when in the non-operating mode. However, after the engine is started and brought up to its operational temperature the hot power block will then tend to bow back in or straighten out to a flat condition.

A further feature to improve the overall durability of the MCC engine is associated with a thermal expansion problem. Revisiting FIG. 14 which again illustrates a single piece connecting bar also shows that this connecting bar is attached to the upper and lower CCM segments 54 and 55. Since this bar is made of an alloy steel material which will operate at a high temperature to help evaporate the fuel droplets during the combustion process, it will transfer a high degree of this heat into the CCM end segments 54 and 55. It has been found that this heat causes higher thermal expansion to occur in the CCM at these attachment points. Consequently it has also been found that the associated adjacent side area of the CCM which interfaces or slides against the front and rear power blocks requires an undercut of about 0.002 inches. This undercut is applied to the small (crosshatched) area 56 under the end seal where the expansion will otherwise be significant enough to cause binding of the CCM between the front and rear power blocks. Normally, this undercut is applied to each side of each connection point or to eight places on the CCM assembly. By means of this modification a proper clearance is established between these hot areas of the CCM and the power blocks to enhance low operational friction and increase durability.

A first manufacturing expedient to help economize the fabrication of the MCC engine utilizes a one piece counterweight hub. This single hub combines several features into a one piece assembly. The specific features which this unit embodies are:

1. Two opposing counterweights which offer optimum counterbalancing compatible with a single overhung crankshaft.

2. An aerodynamic profile which incorporates cooling receptacles to provide a means to cool the front portion of the front power block.

3. Clamping means to receive and clamp the front end of the hub to the front end of the crankshaft.

4. Provision of a back plate to support the rear section of a flywheel, propeller or power take off device. FIG. 2 shows a cross section view of the counterweight hub illustrating counterweights 12 and 13 which were described in U.S. Pat. No. 5,341,774.

Figure 17:
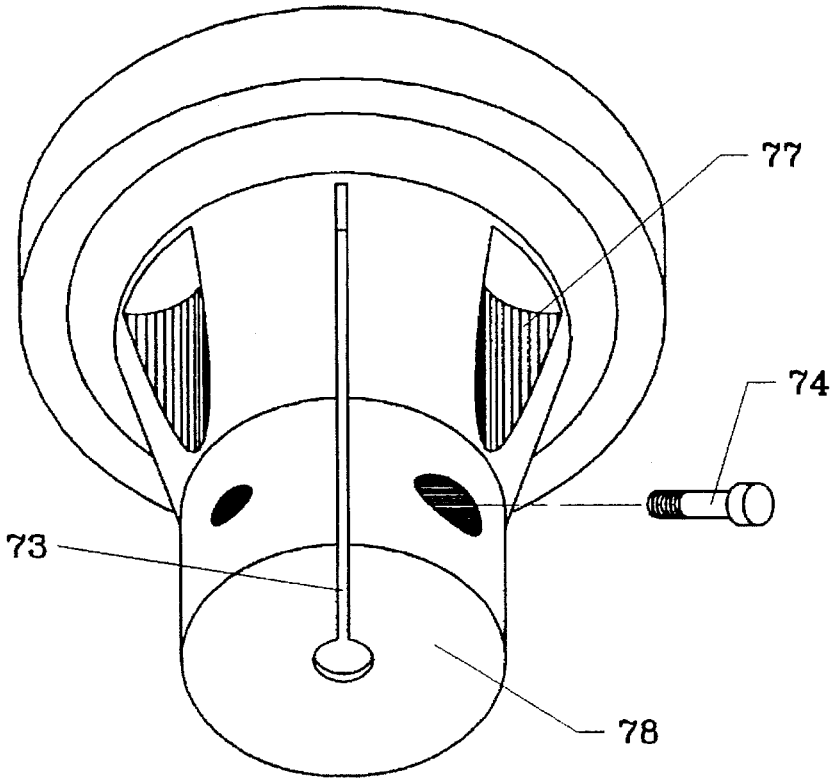
FIG. 17 shows the front view of a counterweight hub with provisions for clamping it to the crankshaft.
Figure 18:
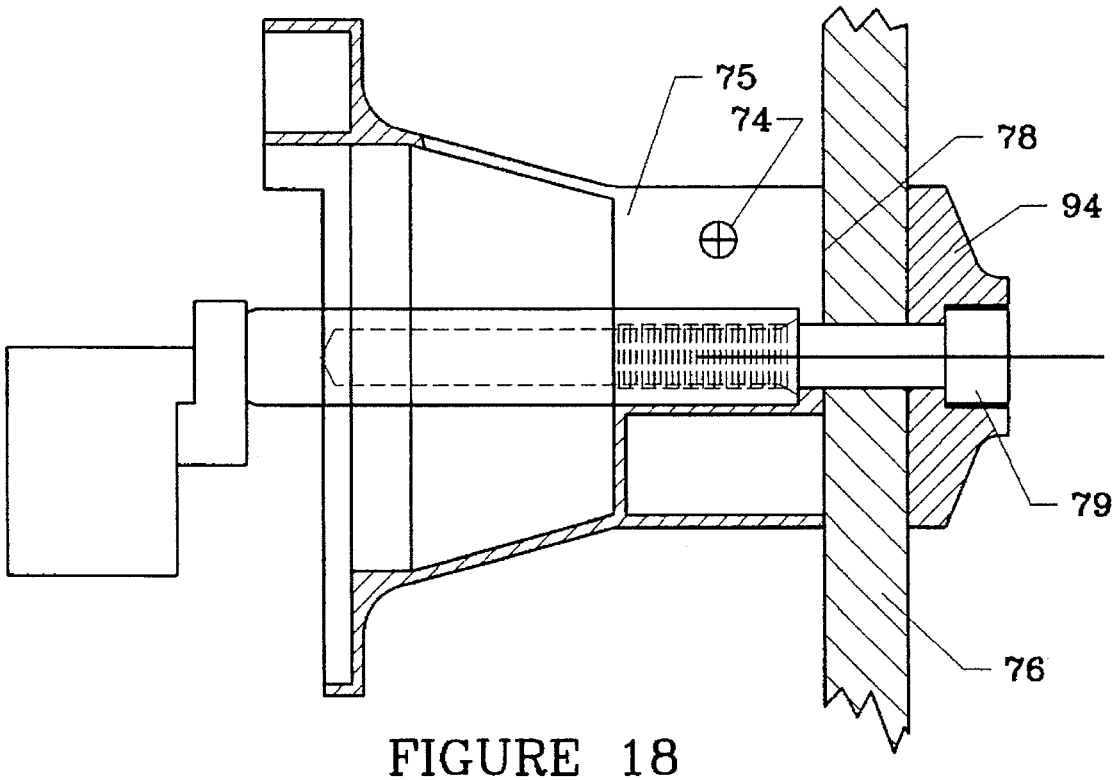
FIG. 18 is a cross section view of the clamp on counterweight hub.

A further manufacturing enhancement feature of this invention is the provision to add a longitudinal slot in the hub as illustrated in FIG. 17. This slot 73 in combination with a locking screw 74 provides a means to clamp the hub securely onto the end of the crankshaft. FIG. 18 shows a cross section view of the crankshaft/counterweight hub assembly. The slot is denoted by the absence of cross hatch in area 75 in which the screw 74 pulls both sides of the slot together to form a clamp around the crankshaft. A further provision to pull the end of the crankshaft into the bore of the hub so the end of the shaft is tight against the bottom of the bore is provided by tightening the screw 79 so that thrust washer 94 clamps against a propeller 76 or power take off device as the screw 79 is tightened into the crankshaft. Other noteworthy features include cooling receptacles such as 77 shown in FIG. 17 which allows cooling air to enter the inside of the hub where it is directed by the inside profile of the hub to impinge on and cool the front area of the front power block. A further provision is a flat support surface 78 which provides a perpendicular surface to mount a power take off conveyance to the hub by an attachment bolt 79 and thrust washer 94.

In the interest of producing an economical engine it has been found that a single piece manifold can incorporate both the induction port tracks and an exhaust track. Also, as discussed previously, combining the exhaust and induction tracks into the same piece provides certain thermal expansion benefits to help control distortion between the manifold and rear power block. Referring again to FIG. 15, a one piece manifold will only require a simple method to bolt a carburetor 69 to the manifold by appropriate screws. This manifold can also provide an extension of the exhaust track 65 by means of a short tubular extension 70 in which a rubber exhaust tube can be installed to carry away the exhaust gases. Also, FIG. 16 illustrates that three silicon o-rings can be installed into three counter bores of the manifold ports to seal against the rear power block ports. Therefore a one piece manifold is disclosed which provides a simple low cost method to couple a fuel/air supply means and an exhaust means to the engine s power block.

Figure 19:
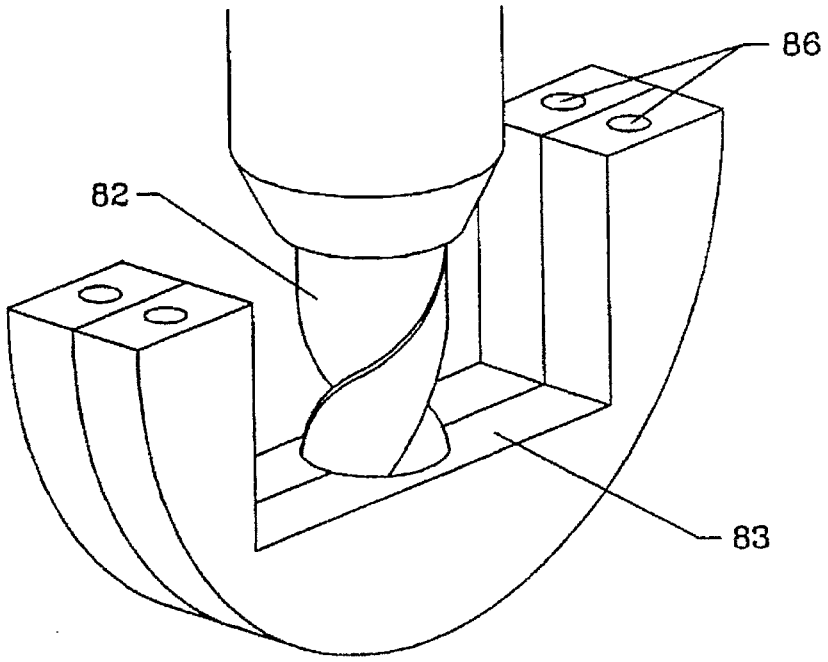
FIG. 19 illustrates precision machining of the inside surface of the center power block which requires a two piece bolt together assembly.
Figure 20:
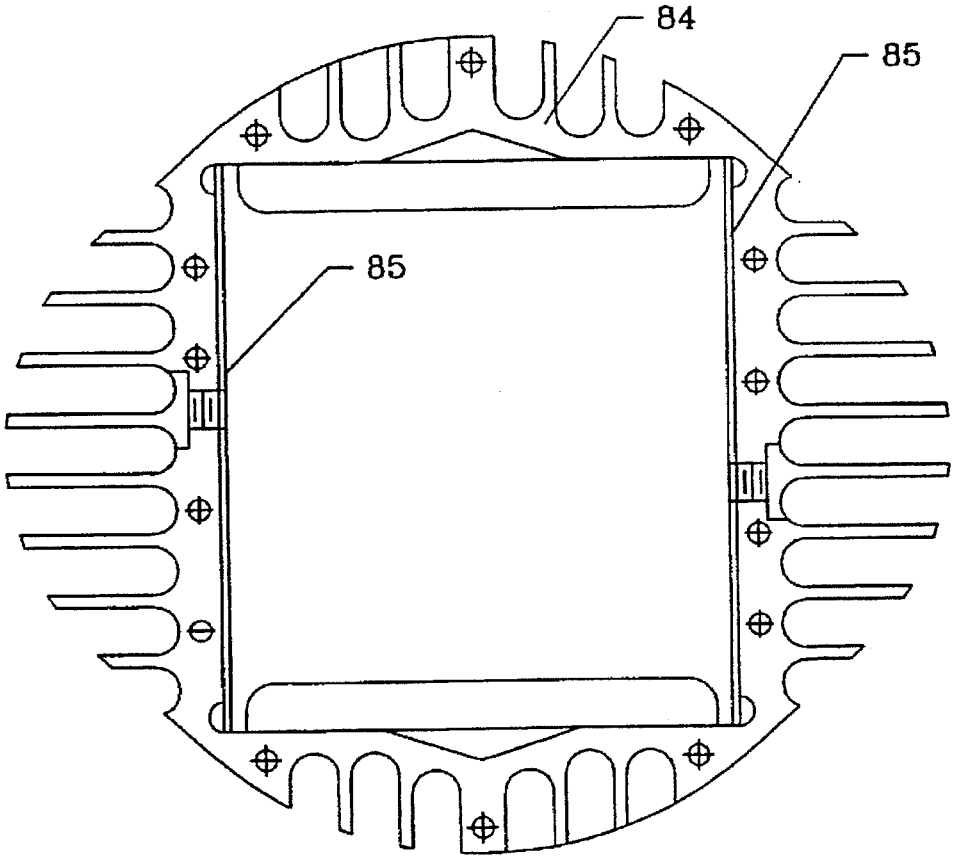
FIG. 20 shows if thin precision wear inserts are used, the center power block can be fabricated as one piece.

To further produce an economical engine, investigations of production methods together with validation testing has produced a simple and less expensive method of producing long lasting sliding surfaces. In particular, it has been found more cost effective to manufacture thin plate sliding surfaces which can be inserted in the engine in places where sliding contact within the moving members are required. Normally, the primary sliding surfaces such as the surfaces on the inside of the center power block which the CCM slides on are precision machined in place and then coated with a wear resistant material such as hard chrome. A final machining operation is then required to produce a precision flat wear surface. This turns out to be a relatively time consuming and expensive process because, for example, the center power block would require to be made in two separate pieces with provisions to bolt them together through bolt holes 86 as illustrated in FIG. 19. In order to machine the sliding surface flat two separate pieces are required to be fixtured in order to provide direct access with a machine tool cutter 82 or grinder to machine the primary sliding surfaces 83 flat and the after coating them, to finish grind them to the correct precision flatness. However, if precision flat ground inserts are utilized as illustrated in FIG. 20, they can be much easier to mass produce as separate thin inserts 85 can simply be inserted into the center power block 84 to provide the necessary flat hard sliding surfaces. Another important advantage of using separate insertable sliding surfaces is that the center power block can be made in one piece instead of two pieces which require bolting together. The single piece power block is much easier to make since the preparation of the sliding surfaces only requires a CNC machined surface finish.

Figure 21:
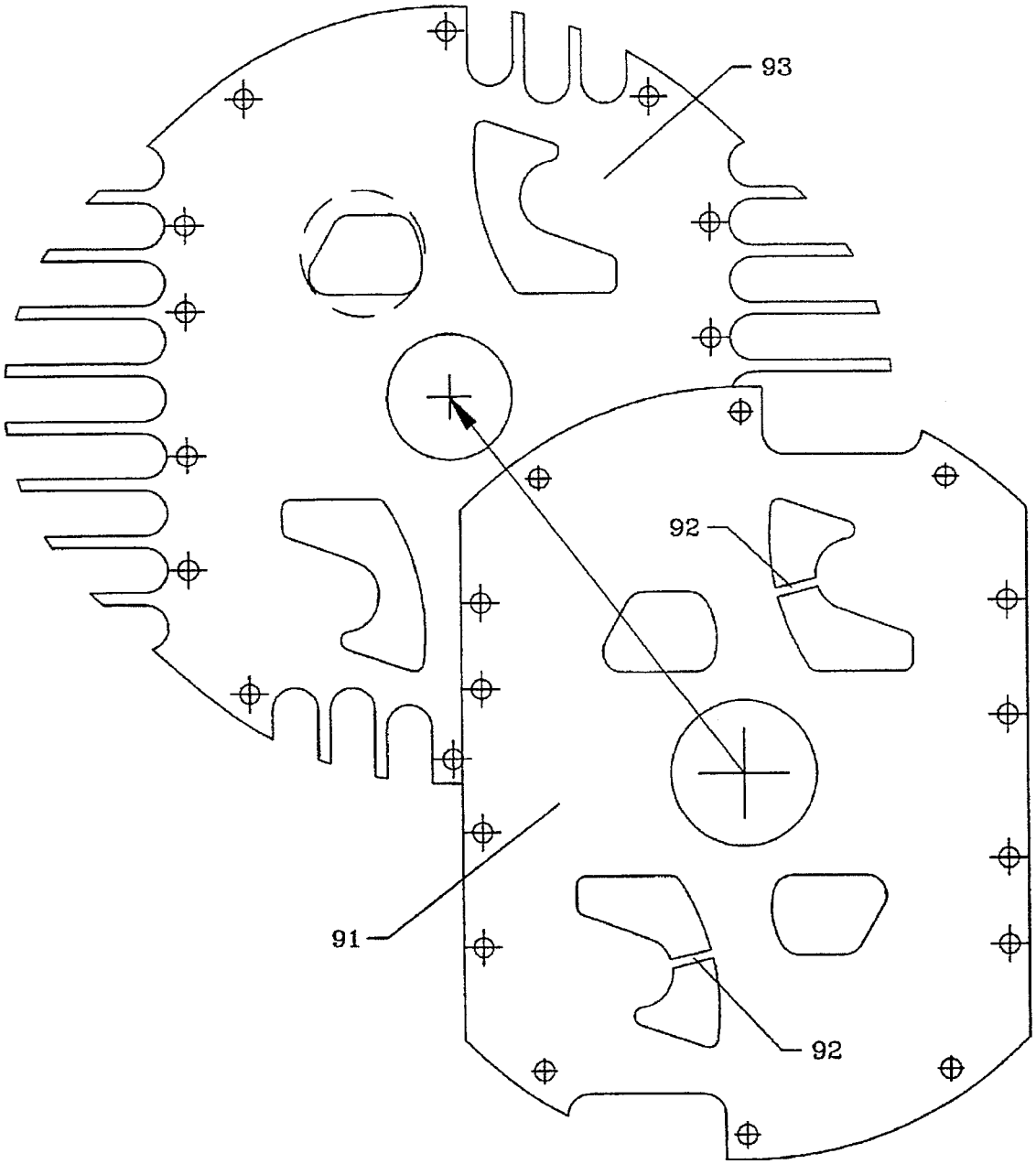
FIG. 21 is an example of how a thin plate can be utilized as a sliding surface for the front and rear power blocks.

Other applications of the insertable thin flat plate include using it as a primary sliding surface for the front and rear power block. In this application a thin plate would replace the entire flat sliding surface of the front and rear power blocks. This would save on the expense and time involved to grind, coat and regrind these surfaces. FIG. 21 illustrates how, for example a single thin precision plate 91 can be placed on to a power block 93. Note that a further advantage resides in being able to incorporate bridges 92 between the side port cutouts to allow sliding continuity of the seal as it travels in a complete circle in order to keep it from falling and hanging up in a port.

From the foregoing, it is now apparent that novel improvements to enhance performance durability and manufacturability of the MCC engine have been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. In a migrating combustion chamber internal combustion engine having a stationary power block housing, a combustion chamber member, an orbiting piston, a crankshaft, and bearing means rotatably joining said crankshaft and said orbiting piston, wherein the orbiting piston is adapted to reciprocate inside and along a first axis relative to the combustion chamber member whereby two combustion chambers are formed with the orbiting piston separating them, and wherein said combustion chamber member is adapted to reciprocate inside and relative to the stationary power block housing along a second axis generally perpendicular to said first axis, whereby the orbiting piston is guided through a circular motion by the crankshaft; and whereby the combustion chambers simultaneously change volume and position, the improvement comprising a plurality of strip seals between said combustion chamber member and orbiting piston, said seals adapted to respond to the pressure of combustion to increase contact pressure and improve retention of the gases in the combustion chambers.

2. The improvement of claim 1 further comprising an additional plurality of strip seals between said combustion chamber member and said power block housing, said additional plurality of seals adapted to respond to the pressure of combustion to increase contact pressure with the power block housing and improve retention of the gases in the combustion chambers.

3. The improvement of claim 1 wherein the orbiting piston includes a plurality of three-sided slots each receiving a strip seal, and further comprising a plurality of springs each interposed between a first slot side and a corresponding seal surface for urging the seals into engagement with the combustion chamber member.

4. The improvement of claim 3 wherein each slot and each seal include relieved regions which cooperate to convey combustion pressure from a combustion chamber to said corresponding seal surface whereby combustion pressure augments spring force in urging a seal into engagement with the combustion chamber member.

5. The improvement of claim 4 wherein the combustion pressure further urges a seal into sealing contact with a second slot side.

6. The improvement of claim 3 wherein said plurality of slots extend generally parallel with one another and generally orthogonal to both said first and second axes.

7. The improvement of claim 1 further comprising a pair of relatively flat independent wear strips extending generally parallel to the first and second axes and interposed between the surfaces of the stationary power block housing, and the combustion chamber member and orbiting piston.

8. The improvement of claim 1 further comprising a rotary valve formed as part of an eccentric portion of the crankshaft for delaying the opening of the exhaust tract from the combustion chamber through the combustion chamber member and orbiting piston to eliminate the reentry of a portion of the previously spent exhaust gases back into a secondary expansion chamber during the initial part of the exhaust function.

9. The improvement of claim 1 wherein the combustion chamber member is formed of two reciprocable piston portions and a pair of separate alloy steel connecting bars coupling the piston portions together, the connecting bars made of a low thermal conductivity material to remain hot and aid in fuel evaporation.

10. The improvement of claim 1 further comprising a one piece counterweight hub for providing all required counterweights, first clamp means for clamping the counterweight hub onto the crankshaft, and second clamp means for pulling an inside bore of the hub axially tight against an end of the crankshaft.

11. In a migrating combustion chamber internal combustion engine having a stationary power block housing, a combustion chamber member, an orbiting piston, a crankshaft, and bearing means rotatably joining said crankshaft and said orbiting piston, wherein the orbiting piston is adapted to reciprocate inside and along a first axis relative to the combustion chamber member whereby two combustion chambers are formed with the orbiting piston separating them and two secondary expansion chambers are formed between the migrating combustion chamber and the stationary power block housing, and wherein said combustion chamber member is adapted to reciprocate inside and relative to the stationary power block housing along a second axis generally perpendicular to said first axis, whereby the orbiting piston is guided through a circular motion by the crankshaft; and whereby the combustion chambers simultaneously change volume and position while the secondary expansion chambers change volume, the improvement comprising porting located in at least one power block sidewall and cooperating with the migrating combustion chamber to convey hot combustion gasses from a combustion chamber to a corresponding secondary expansion chamber.

12. The improvement of claim 11 wherein the port begins to open at an angle $\beta$ after top dead center orbiting piston position, and begins to close earlier at an angle $\beta+\mu$ before top dead center orbiting piston position to reduce the introduction of unburned fuel into the secondary expansion chamber.

13. The improvement of claim 11 further comprising a rotary valve formed as part of an eccentric portion of the crankshaft for delaying the opening of the exhaust tract from the combustion chamber through the combustion chamber member and orbiting piston to eliminate the reentry of a portion of the previously spent exhaust gases back into a secondary expansion chamber during the initial part of the exhaust function.

14. The improvement of claim 13 wherein the exhaust tract includes an exhaust port in the orbiting piston shaped so that there is always a minimum fixed distance between the exhaust port and each of two induction ports as the piston moves around in its orbital path.

15. In a migrating combustion chamber internal combustion engine having a stationary power block housing, a combustion chamber member, an orbiting piston, a crankshaft, and bearing means rotatably joining said crankshaft and said orbiting piston, wherein the orbiting piston is adapted to reciprocate inside and along a first axis relative to the combustion chamber member whereby two combustion chambers are formed with the orbiting piston separating them, and wherein said combustion chamber member is adapted to reciprocate inside and relative to the stationary power block housing along a second axis generally perpendicular to said first axis, whereby the orbiting piston is guided through a circular motion by the crankshaft; and whereby the combustion chambers simultaneously change volume and position, the improvement comprising an ignition source for each combustion chamber located in the stationary power block housing in a location that will be centered relative to the migrating combustion chamber at the point at which ignition actually occurs to achieve the optimum and economical ignition point.

16. The improvement of claim 15 further comprising a one piece combination exhaust and induction manifold for connecting the engine's central exhaust port to an exhaust outlet tube and for coupling the engine's two induction ports to a fuel air mixture source.

17. The improvement of claim 16 wherein the manifold is attached to the stationary power block housing only near the central exhaust area of the manifold while the outer manifold portions engage, but are not fastened to the stationary power block housing.

18. The improvement of claim 17 wherein the central portion of the stationary power block housing is pre-stressed convexly so that upon heating, the central portion of the stationary power block housing will return to a generally flat surface.

19. The improvement of claim 15 wherein the combustion chamber member is formed of two reciprocable piston portions and a pair of separate alloy steel connecting bars coupling the piston portions together, the connecting bars made of a low thermal conductivity material to remain hot and aid in fuel evaporation.

20. The improvement of claim 15 further comprising a one piece counterweight hub for providing all required counterweights, first clamp means for clamping the counterweight hub onto the crankshaft, and second clamp means for pulling an inside bore of the hub axially tight against an end of the crankshaft.

21. The improvement of claim 20 wherein the first clamp means comprises a slot and screw in the hub to clamp on the crankshaft diameter and the second clamp means comprises a bolt and washer axially threaded into the crankshaft end.

22. The improvement of claim 15 further comprising a pair of relatively flat thin wear plates extending generally parallel to the first and second axes and interposed between the surfaces of the stationary power block housing, and the combustion chamber member and orbiting piston.

* * * * *